US006530348B2

(12) United States Patent
Laimböck

(10) Patent No.: US 6,530,348 B2
(45) Date of Patent: Mar. 11, 2003

(54) INTERNAL COMBUSTION ENGINE

(75) Inventor: Franz Laimböck, Thal (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/894,873

(22) Filed: Jun. 29, 2001

(65) Prior Publication Data

US 2002/0029752 A1 Mar. 14, 2002

(30) Foreign Application Priority Data

Jul. 3, 2000 (AT) ..... 487/2000

(51) Int. Cl.[7] ..... F01P 9/04
(52) U.S. Cl. ..... 123/41.57; 123/41.69
(58) Field of Search ..... 123/41.57, 41.69

(56) References Cited

FOREIGN PATENT DOCUMENTS

WO 8401979 5/1984

*Primary Examiner*—Noah P. Kamen
(74) *Attorney, Agent, or Firm*—Dykema Gossett PLLC

(57) ABSTRACT

An internal combustion engine includes a cylinder block with cooling fins cast integral therewith, and a cylinder head bolted on top of the cylinder block, first coolant passages being provided in the area of at least one cylinder contained in the cylinder block, which passages are connected to second coolant passages located in the cylinder head. Cooling efficiency is increased by providing heat exchange passages in an outer region of the cooling fins, which together with the first coolant passages and the second coolant passages, form a closed loop system within the engine.

10 Claims, 2 Drawing Sheets

INTERNAL COMBUSTION ENGINE

BACKGROUND OF THE INVENTION

The invention relates to an internal combustion engine comprising a cylinder block with cooling fins cast integral therewith, and a cylinder head bolted on top of the cylinder block, first coolant passages being provided in the area of at least one cylinder contained in the cylinder block, which passages are connected to second coolant passages located in the cylinder head.

Air-cooled internal combustion engines offer a number of advantages when used with motorcycles, carts, etc. Simplicity of design is one of them, as no coolant pumps, external radiators or the like will be required. Besides, outward appearance of the engine often is important since an engine rigged up with cooling fins is regarded as aesthetically pleasing. The drawback of air-cooled engines is their lesser performance as a consequence of the limited possibility of heat dissipation, and non-uniform heat distribution due to the fact that the internal heat exchange will not be as efficient as with liquid-cooled engines. In motorcycles, for example, the front sides of the cylinders are usually cooled much more efficiently than the back sides on account of the ambient airflow prevailing. In the instance of V-engines where the crankshaft is positioned transversely to the longitudinal axis of the vehicle, thermal conditions at the rear cylinder usually are less satisfactory.

DESCRIPTION OF PRIOR ART

In WO 84/01979 a cooling system for internal combustion engines is disclosed where the cooling medium evaporates partially. Condensation takes place in an external radiator. The design of such a cooling system is relatively complex.

SUMMARY OF THE INVENTION

It is an object of this invention to propose an internal combustion engine where the above disadvantages are eliminated while the advantages of an air cooling system as described above will be maintained and engine performance may be increased by improving cooling efficiency.

According to the invention this object is achieved by providing heat exchange passages in the outer region of the cooling fins, which together with the first and second coolant passages form a closed loop system within the engine. By means of this simple design a liquid cooling system may be obtained which will not necessitate an external radiator. Thus the outward appearance of motorcycles and other vehicles will not be impaired by such a radiator. The invention is essentially based on the fact that, while the thermal efficiency of cooling fins will increase with their height, any additional increase beyond a certain limit will improve cooling only marginally. Thanks to the invention it will also be possible to efficiently utilize the outer region of the cooling fins for the cooling system.

An especially favorable design solution is achieved by providing connecting bores in the lower part of the cylinder block, in order to connect the heat exchange passages to the first coolant passages. Considering that the heat exchange passages run essentially vertically when the engine is mounted in the vehicle, the thermosiphon effect, which causes the coolant to circulate, will be optimized. Most advantageously, the coolant will be allowed to reach boiling temperature in the first coolant passages when the engine is subjected to extremely high loads. Boiling of the coolant will accelerate its circulation considerably and thus improve cooling efficiency. To ensure that pressures will remain within acceptable limits in the boiling state of the coolant, it may be provided by the invention that an expansion tank be formed in the upper part of the cylinder head, which is designed for volume compensation.

In a particularly favorable variant of the invention the heat exchange passages are located in the outer region of the cooling fins. In this way the cooling fins may be utilized as heat exchange surfaces against the ambient air to special advantage.

An especially favored design is obtained by combining a number of heat exchange passages into a cooling bank which is connected to the other coolant passages via a single opening. In this manner the number of connections requiring seals between the cylinder block and the cylinder head may be minimized.

An internal combustion engine of great thermal efficiency will be obtained by surrounding the engine cylinder by several cooling banks. Preferably, the cooling bank is connected to the first coolant passages via a single connecting bore. In this way an excellent internal heat exchange will be possible.

No coolant pump will be required if the first coolant passages, and the second coolant passages, and the heat exchange passages form a closed loop system within which the coolant is allowed to circulate freely.

Due to the absence of mechanically moveable parts a long-lived system of great robustness will be obtained.

BRIEF DESCRIPTION OF THE DRAWINGS

The invention will be explained in more detail below with reference to the attached drawings, wherein.

DETAILED DESCRIPTION OF THE PREFERRED EMBODIMENT

Figure 1:
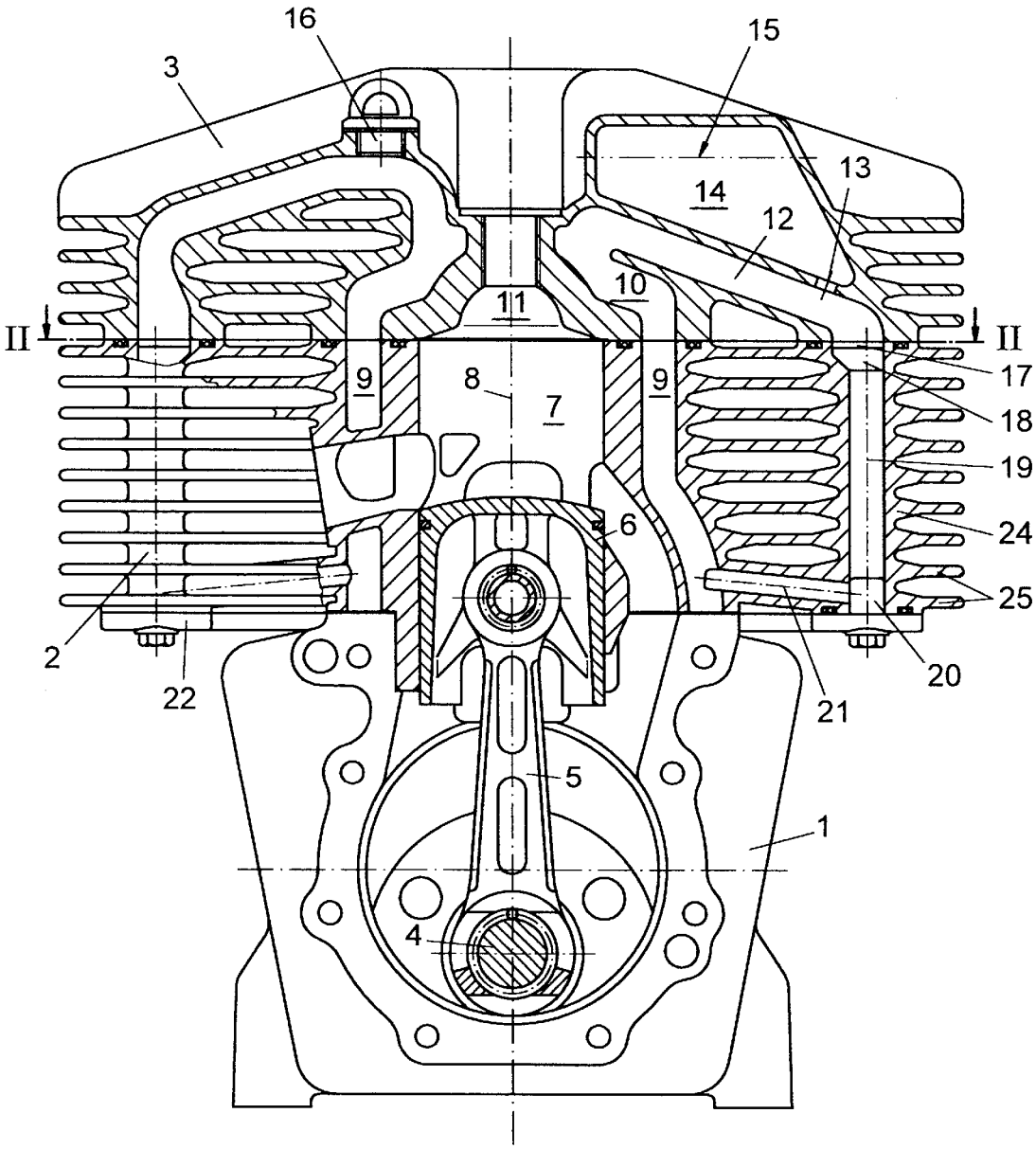
FIG. 1 shows a longitudinal section of an internal combustion engine according to the invention.
Figure 2:
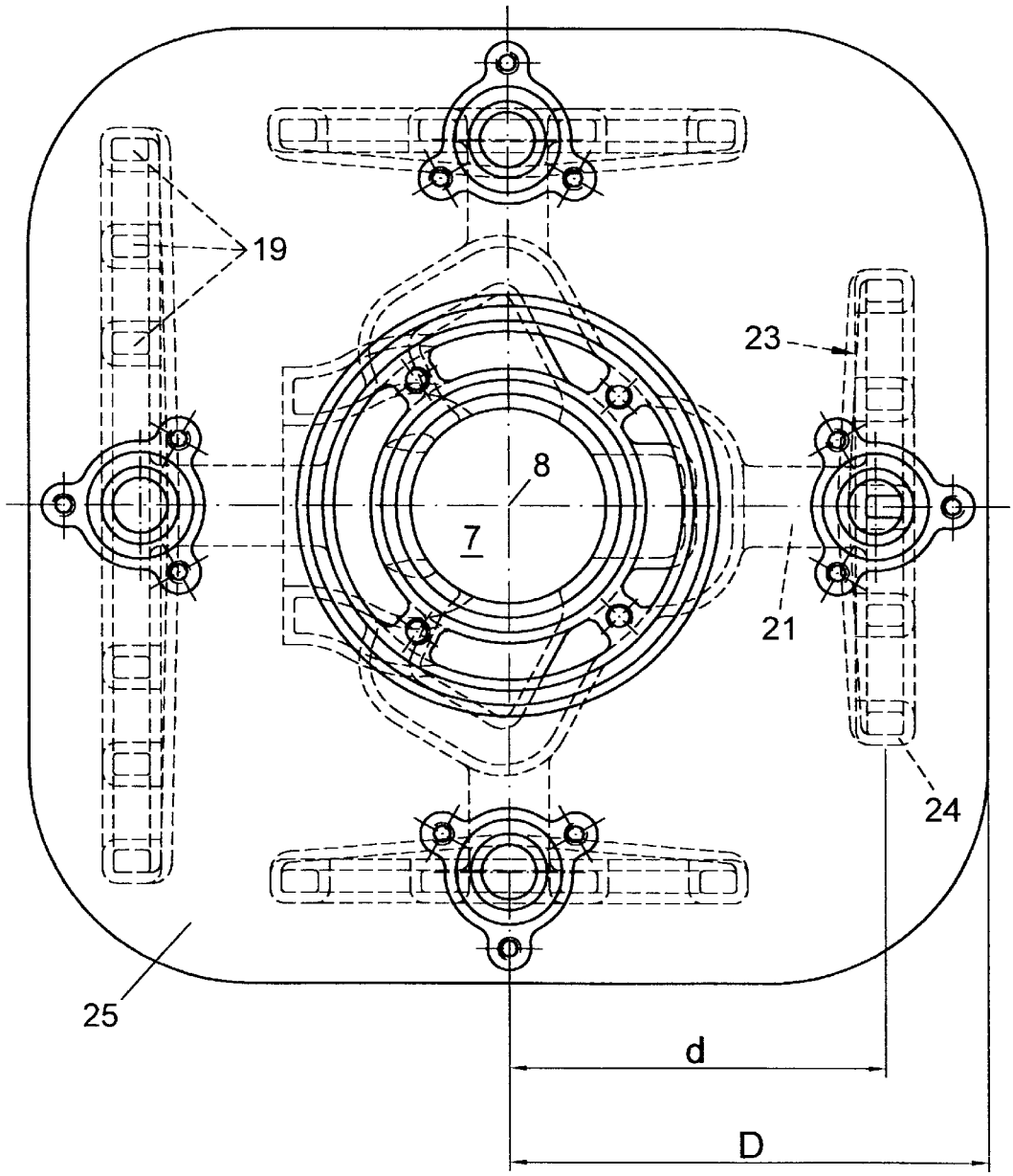
FIG. 2 shows a view from above of the cylinder block of the engine in FIG. 1.

The engine according to FIG. 1 and FIG. 2 comprises an engine block 1, and a cylinder block 2 with a cylinder head 3 bolted on top of it. The engine block 1 contains a crankshaft 4 connected to a piston 6 via a connecting rod 5, said piston 6 moving to and fro along the cylinder axis 8. The cylinder 7 is surrounded by first coolant passages 9 running essentially parallel to the cylinder axis 8 and extending vertically from top to bottom. The first coolant passages 9 are connected to second coolant passages 10 in the cylinder head 3, which follow the contour of the combustion space 11 before entering a connecting section 12 leading to the outside. The second coolant passages 10 are connected via a connecting bore 13 inside the cylinder head 3 to an expansion tank 14 which is partially filled with coolant during operation. The level 15 of the coolant is essentially defined by the height of a filler opening 16. The connecting sections 12 each are in connection with a connecting opening 17 in the outer region of the cylinder block 2, which is joined by a distributing duct 18 immediately below the cylinder head 3, from which a number of heat exchange passages 19 lead downwards in vertical direction. In the lower part of the cylinder block 2 the heat exchange passages 19 open into a collecting duct 20, which is in connection with the first coolant passages 9 via a connecting bore 21. Covers 22 close the heat exchange passages 19 at the bottom.

The heat exchange passages 19 form a total of four banks 23 running in parallel to the crankshaft axis or at a right angle thereto. The individual heat exchange passages 19 are located in lugs 24 of the cooling fins 25, distance d between the individual banks 23 and the cylinder axis amounting to about 70% of distance D between the rims of the cooling fins 25 and the cylinder axis 8.

The present invention combines the advantages of air-cooled engines and those of liquid-cooled engines in a simple way.

What is claimed is:

1. An internal combustion engine comprising a cylinder block with cooling fins cast integral therewith, and a cylinder head bolted on top of the cylinder block, first coolant passages being provided in an area of at least one cylinder contained in the cylinder block, which passages are connected to second coolant passages located in the cylinder head, wherein heat exchange passages are provided in an outer region of the cooling fins, which heat exchange passages, together with the first coolant passages and the second coolant passages, form a closed loop system within the engine.

2. An engine according to claim 1, wherein connecting bores are provided in a lower part of the cylinder block, which will connect the heat exchange passages to the first coolant passages.

3. An engine according to claim 1, wherein the heat exchange passages extend essentially vertically when the engine is mounted in the vehicle.

4. An engine according to claim 1, wherein an expansion tank is formed in an upper part of the cylinder head, which is designed for volume compensation.

5. An engine according to claim 1, wherein the coolant passages and the heat exchange passages are filled with a coolant whose boiling temperature will permit partial evaporation of the coolant in the coolant passages.

6. An engine according to claim 1, wherein all heat exchange passages are located in an outer region of the cooling fins.

7. An engine according to claim 1, wherein a number of heat exchange passages are combined in a cooling bank, which is connected to the other coolant passages via a single connecting opening.

8. An engine according to claim 7, wherein the cylinder of the engine is surrounded by a number of cooling banks.

9. An engine according to claim, wherein the cooling bank is connected to the first coolant passages via a single connecting bore.

10. An engine according to claim 1, wherein the first coolant passages, the second coolant passages, and the heat exchange passages form a closed loop system within which the coolant circulates freely.

* * * * *